US006116255A

United States Patent [19]

Walter

[11] Patent Number: 6,116,255

[45] Date of Patent: Sep. 12, 2000

[54] PAINT ROLLER WASHER AND SPIN DRYER

[75] Inventor: William R. Walter, Baker, Oreg.

[73] Assignee: The Walter Trust, Baker City, Oreg.; William R. Walter & Evelyn Joyce Walter, trustees

[21] Appl. No.: 09/072,720

[22] Filed: May 4, 1998

[51] Int. Cl.[7] ..... B08B 3/00; A45D 44/18; B65D 83/10

[52] U.S. Cl. ..... 134/138; 134/900; 206/15.3; 206/361

[58] Field of Search ..... 134/900, 138; 206/15.3, 361

[56] References Cited

U.S. PATENT DOCUMENTS

| | | | |
|---|---|---|---|
| 3,075,534 | 1/1963 | Habostad . | |
| 3,577,280 | 5/1971 | George | 134/138 |
| 3,688,785 | 9/1972 | Stevens et al. | 134/138 |
| 3,837,091 | 9/1974 | Meyer | 34/58 |
| 3,897,797 | 8/1975 | Wright et al. | 134/113 |
| 4,108,189 | 8/1978 | Claiborne | 134/138 |
| 4,126,484 | 11/1978 | Monteiro | 134/34 |
| 4,130,124 | 12/1978 | Sherwin | 134/138 |
| 4,142,540 | 3/1979 | Vegiard | 134/138 |
| 4,155,230 | 5/1979 | Lacher, Jr. | 68/213 |
| 4,172,373 | 10/1979 | Lary | 68/213 |
| 4,200,949 | 5/1980 | Heniff, Jr. | 15/257.06 |
| 4,237,575 | 12/1980 | Mlachnik | 15/230.11 |
| 4,299,949 | 11/1981 | Heniff, Jr. | 15/257.06 |
| 4,311,158 | 1/1982 | Harvey | 134/138 |
| 4,446,590 | 5/1984 | Kirchner et al. | 15/302 |
| 4,569,099 | 2/1986 | Harding | 15/248 A |
| 4,606,777 | 8/1986 | Brow | 134/38 |
| 4,641,673 | 2/1987 | Conley et al. | 134/138 |
| 4,667,361 | 5/1987 | Wolcott et al. | 15/236 |
| 4,672,987 | 6/1987 | Brandt | 134/138 |
| 4,708,152 | 11/1987 | Hibberd | 134/138 |
| 4,733,679 | 3/1988 | Dolcater | 134/138 |
| 4,735,221 | 4/1988 | Vegiard | 134/138 |
| 4,765,354 | 8/1988 | Thatcher et al. | 134/182 |
| 4,809,722 | 3/1989 | Pennise | 134/138 |
| 5,050,626 | 9/1991 | Brockage | 134/138 |
| 5,095,928 | 3/1992 | Phipps | 134/138 |
| 5,185,938 | 2/1993 | Hutt | 34/58 |
| 5,238,012 | 8/1993 | Coronato | 134/140 |
| 5,322,081 | 6/1994 | Isaac | 134/182 |
| 5,345,648 | 9/1994 | Graves | 15/230.11 |
| 5,402,808 | 4/1995 | Wallis | 134/104.2 |
| 5,413,133 | 5/1995 | Russell | 134/138 |
| 5,452,734 | 9/1995 | Steeves | 134/186 |
| 5,487,399 | 1/1996 | Hannah | 134/138 |
| 5,490,303 | 2/1996 | Graves | 15/230.11 |
| 5,505,220 | 4/1996 | Gorecki | 134/138 |
| 5,544,668 | 8/1996 | Dollar | 134/104.2 |
| 5,544,688 | 8/1996 | Dollar | 134/104.2 |
| 5,614,021 | 3/1997 | Catlin | 118/258 |
| 5,626,158 | 5/1997 | Gratopp | 134/138 |
| 5,645,091 | 7/1997 | Hoeft | 134/84 |
| 5,797,410 | 8/1998 | Gates | 134/138 |

*Primary Examiner*—Frankie L. Stinson
*Assistant Examiner*—Paul J. Lee

[57] ABSTRACT

Disclosed herein is an apparatus whereby a paint roller can quickly be cleaned, fluffed, and rendered damp-dry with the operator and cleaning area completely shielded from the splatter of solvent and paint. The washing and spin drying actions are produced by a high velocity single jet of water or other solvent delivered through a hand-held spray wand within the confines of a hand-held, tapered cylindrical enclosure.

The enclosure is open at the top for insertion of both the paint laden roller and the spray wand, and for visual access into the cleaning process. It's in-rolled upper rim eliminates egress of random splatter. It's open bottom affords rapid exhaust, and being tapered throughout, permits enclosure elements to be nested for efficient quantity packaging. The detachable handle, when affixed to the enclosure and properly adjusted, accommodates nearly any paint roller handle design. The enclosure handle mates with a segment of the paint roller handle in such a way that the two can be held as a single unit in the operator's hand of choice leaving the other hand free to manipulate the spray wand.

11 Claims, 2 Drawing Sheets

PAINT ROLLER WASHER AND SPIN DRYER

BACKGROUND

1. Field of Invention

This invention relates to paint roller cleaners, specifically to such cleaners that use water or other solvents and centrifugal action to clean paint rollers.

2. Description of Prior Art

Although more than two dozen patents of this genre have been issued within the past two decades, paint specialty and general merchandise stores rarely offer any selection. Not one of the 24 patented devices reviewed posses all of the features herein deemed essential. Such a device must be easy to use, durable, inexpensive and require no maintenance. It must shield the operator and cleaning area from paint and solvent splatter. It must render the roller ready for immediate reuse or storage. It must accommodate the full variety of common paint rollers, and perform its function without having to remove the roller from its handle.

Ten (10) previously patented devices require removal of the roller cover prior to installation in the device. U.S. Pat. Nos. 4,155,230; 4,237,575, 4,311,158; 4,708,152; 4,733, 679; 5,185,938; 5,345,648; 5,452,734; 5,487,399; 5,490, 303.

Seven (7) patents have been issued for devices which provide no drying action. U.S. Pat. Nos. 4,126,484; 4,155, 230; 4,172,373; 4,606,777; 4,765,354; 5,322,081; 5,452, 734.

Eight (8) of these patented devices wash and spin the paint roller through a "plurality of jets". This attempt to provide "full length cleaning coverage" seriously reduces the penetrating and spinning power available in normal domestic water systems. Likewise, unless the jets are closely spaced, these devices leave poorly cleaned bands on the paint roller. U.S. Pat. Nos. 4,130,124; 4,446,590; 4,708,152; 5,050,626; 5,402,808; 5,505,220; 5,614,021; 5,626,158.

One (1) U.S. Pat. No: 4,108,189 provides a "fan-shaped" discharge of water "contacting the roller throughout its entire length". Being continuous, such a spray action would eliminate the "banded cleaning effect" of the previous nine devices, but it shares the main problem, a serious reduction in penetrating and spinning power by spreading that force over the entire length of the roller.

One (1) U.S. Pat. No. 3,075,534 issued to A. Harbostad in 1963 has some of the above listed essential features. The principal defect of this device is its limited usability. The only paint rollers which will fit the device are those with 90 degree bends in the handle. Most of the paint roller handles on the market would not fit this device, even if it were available. Other defects include enclosed bottom, seriously occluded exhaust which allows accumulation of swirling liquid during spin drying as well as design features adversely effecting manufactureability and cost.

A need yet remains for a paint roller washer and spin dryer which possesses all of the essential characteristics described above. The plethora of patents issued plus the dearth of devices on the market attest to the need as being recognized but unmet.

All the Paint Roller Cleaners heretofore known suffer from a number of disadvantages:

a) Cleaners that feature removal of the roller from the handle prior to cleaning require the operator to handle the paint covered roller. This is time consuming and messy.
b) Devices which leave the finished roller wet do not prepare the roller for immediate reuse or storage.

c) Devices which cannot provide deep cleaning and high speed spin action because the available force is spread throughout the full length of the roller.
d) Devices that are unable to accommodate the variety of common roller designs.

SUMMARY OF THE INVENTION

Accordingly, besides the objects and advantages of the paint roller cleaner described herein, several objects and advantages of the present invention are:

(a) The device consisting of a handled cylindrical enclosure (FIG. 1) and a special 90 degree spray wand (FIG. 2) provides the total cleaning and spin-drying action to restore a used paint roller to a "ready to use" condition.

(b) Adjustable handle (5) for enclosure can be positioned to accommodate various angular ratios as needed to mate with various roller handle design requirements.

(c ) Indexing groove (13) in handle (5) affixes roller position axially and centrally within the enclosure.

(d) Indexing notch (3) in enclosure upper rim (14) affixes the roller position laterally and vertically within the enclosure.

(e) Inward rolling upper rim (14) of the enclosure minimizes splatter through the upper opening.

(f) Cutout (4) in upper rim (14) to accommodate spray wand (2) insertion and to serve as guide for vertical wand movement.

(g) Spray orifice (10) located near the end of spray wand (2) directs spray perpendicular to wand axis, hence directly into the paint roller fibers for deep penetration.

(h) Enlargement of wand tip diameter (11) serves as up limit stop to reduce likelihood of unintentional withdrawal with spray activated.

(i) Open top of enclosure (15) permits visual access into the cleaning operation.

(j) Tapered design of enclosure cylinder (1) permits nesting of unassembled units (FIG. 6) for efficient packing and shipping.

(k) Open bottom of enclosure (16) provides rapid exhaust of solvent and permits nesting of unassembled unit (FIG. 6).

(l) Handle mount yoke (12) shaped to permit a wide range of angular and in/out positions of the enclosure handle (5).

(m) Mounting bands (6 & 7) designed for ease of installation and removal and for firm holding of handle mount yoke (12).

(n) Standard hose connector (18).

DETAILED DESCRIPTION OF THE INVENTION

Figure 1:
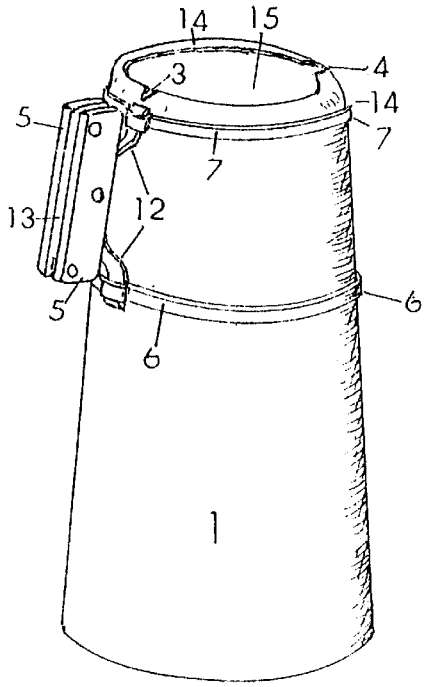
FIG. 1 A perspective of a cylindrical cone shaped enclosure.
Figure 2:
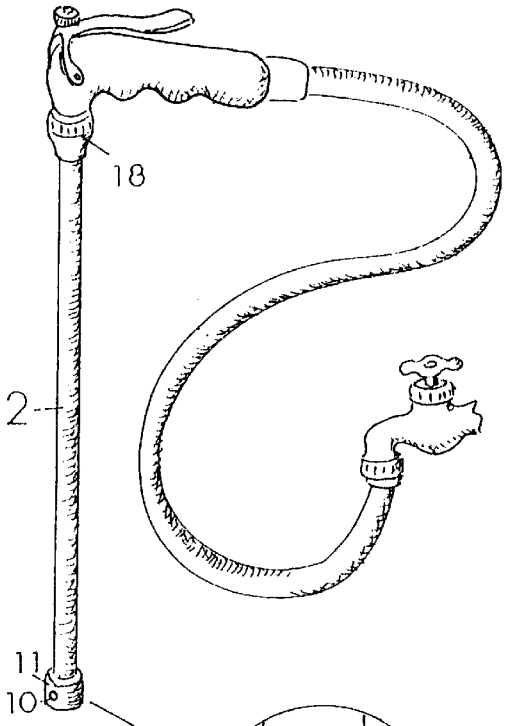
FIG. 2 A perspective of the spray wand showing hand control valve and hose connected to a water faucet FIG. 2*a* Enlarged view of wand tip showing spray orifice and enlarged tip for up stop.
Figure 2A:
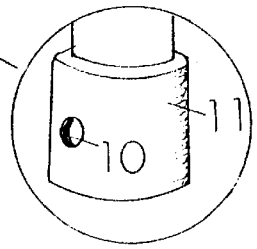
Figure 3:
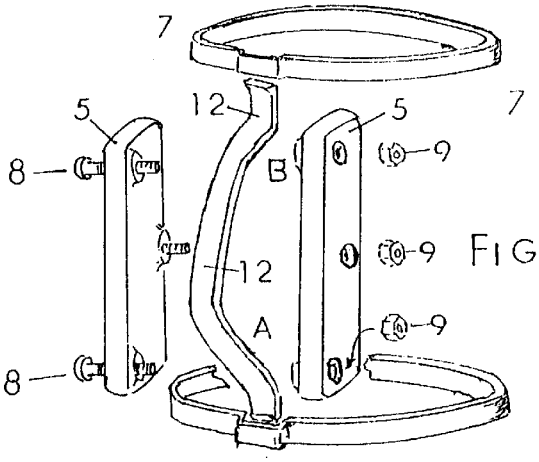
FIG. 3 A perspective of the handle and handle mount assembly components unassembled.
Figure 4:
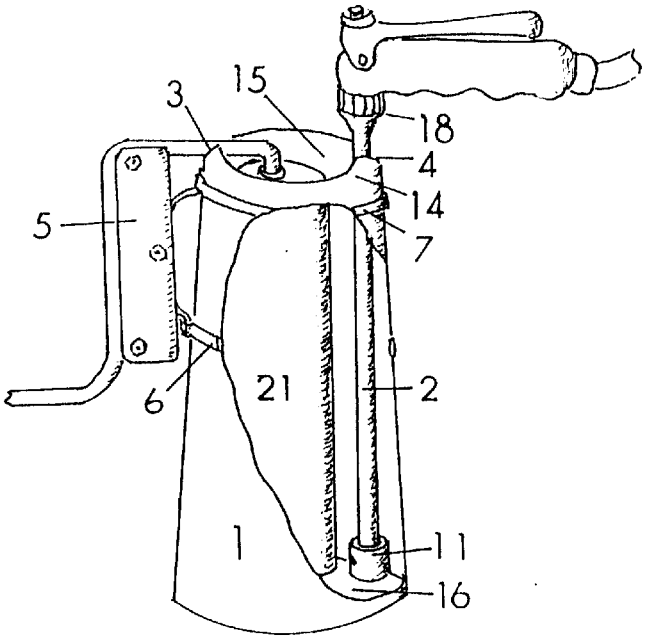
FIG. 4 A cutaway perspective view of the cleaning enclosure with paint roller and spray wand installed as for a cleaning operation at down-limit of insertion.
Figure 5:
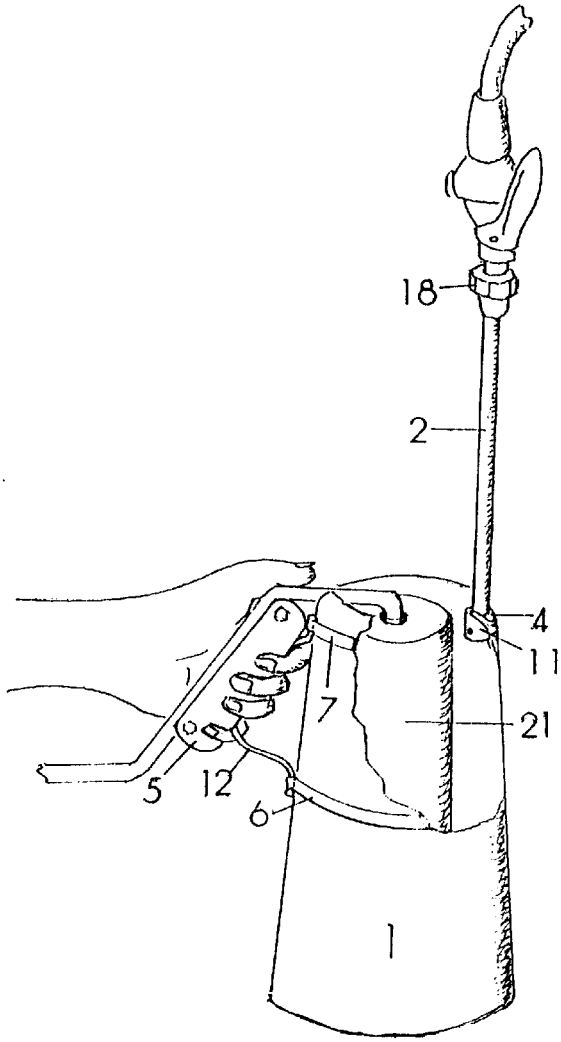
FIG. 5 Differs from FIG. 4 showing handle adjustment to accommodate a roller handle with larger than 90 degree bend and a spray wand at up limit of insertion.
Figure 6:
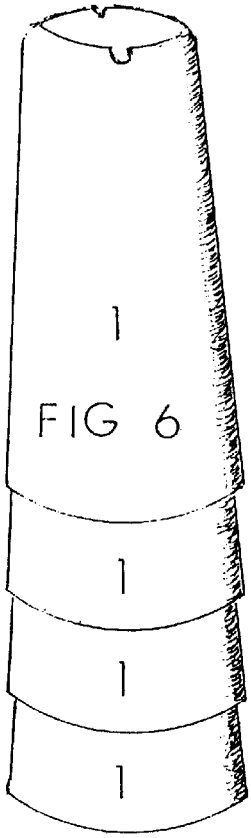
FIG. 6 A perspective showing four enclosure units nested for quantity packaging.

The cylindrical, cone shaped enclosure fitted with an adjustable handle as represented in FIG. 1, coupled with the spray wand represented in FIG. 2, together comprise the device herein disclosed and defined as a paint roller washer and spin-dryer. Said adjustable handle (5) shown adjusted to mate with a 90 degree angle roller handle in FIG. 4 and with a 120 degree angle roller handle in FIG. 5, is affixed to the protective enclosure by use of the mounting assembly. The handle and mount assemblies shown attached to the enclosure in FIGS. 1,4, & 5, are shown unassembled in FIG. 3.

In this embodiment the handle is composed of two identical parts (5) affixed to the mounting yoke (12) with bolts (8) and nut (9). The yoke (12) is somewhat flexible and asymmetrical with a long (A) and a short (B) leg. These characteristics of the yoke permit it to be mounted either end up, and arched (FIG. 5) or flattened (FIG. 4) as needed to permit a wide range of handle adjustments. Held firmly in position by lower mounting band (6) and upper mounting band (7), control of the shape of the yoke is afforded by adjusting the relative positions of the mounting bands (6,7). The installed shape and orientation of the yoke determines the limits of angular adjustment of the handle and the limits of the distance between the handle and the enclosure. Said angle and said distance are determining factors in orienting paint rollers of differing designs and dimensions within the cleaning enclosure.

When the handle (5) is adjusted and clamped into position on the yoke by tightening bolts (8) the installed paint roller and the enclosure are held in a fixed relation by one hand. Thus adjusted and held, the roller is free to rotate within the enclosure. Any roller contact with the inner surface of the closure indicates further adjustment is needed. Thus, with the paint roller held in a fixed position within the enclosure as shown in FIG. 5, the operator's other hand is free to grasp, insert, and control the spray wand (2). The spray wand cut out (4) is the point of insertion where the wand (2) will avoid contact with the paint roller (21). The overall length of the wand is such as contact of the spray valve connector with the upper rim of the enclosure FIG. 4 (4) serves to prevent releasing the spray below the enclosure. Contact of enlarged end of the wand FIG. 5 (11) with the in-rolled upper rim (14) serves as protection from inadvertent withdrawal during the cleaning operation.

The spray wand assembly shown in FIG. 2 consists of the wand (2) with orifice at the tip (10) 90 degrees to the wand axis, hand control valve (19), and hose (20) connected to a faucet, either out of doors or at a sink or laundry tub. Water pressure and volumes deemed adequate for domestic supply, when communicated through the control valve (19) to the wand (2) and spray orifice (10), produce a jet of water sufficient in force to penetrate deeply into the pile (21 ) of the paint roller. Looking downward through the enclosures open top, the operator can observe this action, noticing how the angle of impingement of the jet on the roller surface controls the roller rotation, and how full length coverage is obtained by inserting and withdrawing the spray wand. After deeply soaking the complete surface by allowing incremental rotation movements as the wand is inserted and withdrawn several times stop to stop, the spray jet can then be directed to the outer perimeter of the roller to initiate the spin dry cycle. The centrifugal force generated in a high speed spin throws off the solvent and paint residues, extends the roller fibers and renders the roller ready for storage or immediate reuse.

Operation FIGS. 1–6

Prior to operating the Paint Roller Cleaner and Spin Dryer to clean paint rollers, a one time initial assembly is required followed by two adjustments. The adjustment procedures need be followed only once for a given style of roller.

Assembly

The parts for assembly include: Cone (1), lower band (6), upper band (7), yoke (12), handle pieces (two identical) (5), three stove bolts (8), three nuts (9). The only tool required is a blade screwdriver.

To assemble, first stand cone on work bench, large end down, V notch in upper rim toward assembler. Place lower band over cone with shaped segment directly in line below the V notch. Select leg of yoke to insert downward into that space, or socket, formed between the shaped band segment and the cone wall. Press the band and yoke downward for a snug fit. Place the upper band over the cone. Hook it's shaped segment over the upper leg of the yoke. Press the upper leg and band snugly into position. Determine that the yoke is vertical with both ends in line with the V notch. Note how the identical handle parts must be positioned side by side for a comfortable hand hold with space between to accommodate the yoke arch. Place one handle piece on each side of the yoke and grasp the two with one hand. Insert a bolt in each of the three holes so that their round heads sink down into the hex shaped depressions in the handle. Install a nut in each of the hex shaped depressions on the opposite handle piece and rotate each bolt clockwise with the screwdriver until the handle is barely snug.

A paint roller can now be installed with a segment of its handle lying along the palm side of the handle. With the handle and paint roller held firmly in one hand adjust the position of the paint roller cylinder within the enclosure by grasping either the upper rim or the lower rim of the enclosure with the other hand and by pushing or pulling as is needed. When the roller is not touching the inner surface of the cone and there is sufficient space to insert the spray wand the adjustment is complete. Tighten the three handle bolts to affix the handle securely in that position.

If there is not enough freedom of movement of the handle to achieve complete adjustment two other possible adjustments can be made which will extend the range in one direction while limiting the range in the other. First, the yoke/handle assembly can be reversed by simply loosening the bands, slipping the yoke legs out of their sockets and reinserting other leg up. Second, the yoke arch can easily be modified by tightening the bands in such a way that the arch is flattened by increasing the distance between the sockets, or the arch can be exaggerated by shortening the distance between the sockets.

The final tightening process is accomplished by simply forcing the bands downward. Laying the flat of the screwdriver blade on the edge of the band and pressing downward will accomplish this. With the screwdriver held horizontally in one hand lay the tip of the blade on the band edge. With the palm of the other hand press down on the blade near the tip or strike the blade with the edge of the hand. Repeat this process around the circumference of the band until the desired tightness is achieved.

Adjustment

After assembly, an initial adjustment of the handle and spray wand are performed. To adjust the handle, insert the dry roller into the cleaning enclosure, align their respective handles and grasp the mated handles firmly in one hand as though following the cleaning procedure. Notice the position of the paint applicator cylinder within the enclosure by looking down through the open top. Any contact of the cylinder with the enclosure wall indicates the need for handle adjustment. Loosen the three handle bolts slightly to allow movement of handle in relation to the yoke in response to firm pressure. With the handle and installed paint roller held firmly in one hand adjust the position of the roller cylinder within the enclosure by grasping either the upper rim or the lower rim of the cone with the other hand and by pushing or pulling as needed. Retighten the three handle bolts. If there is not enough adjustment range for the roller's requirements see the assembly instructions, above, for altering the yoke arch or reversing the yoke. Device may be used repeatedly with no further adjustments unless a roller of a different design is to be cleaned.

To adjust the spray wand, hold the paint roller/cleaner assembly in one hand and the spray wand in the other hand as though following the cleaning procedure. When the wand is held in the cleaning enclosure the spray orifice must point toward the roller cylinder. If it does not, loosen the finger-tight wand attachment nut, rotate the wand to the desired position and retighten the nut.

Operation

Operation of the Paint Roller Cleaner and Spin Dryer first requires a connection to a cold water source. Select a source of cold water at standard domestic pressure near a sink or other place appropriate for the exhaust and disposal of water and paint residues. Connect one end of the supply hose to the water faucet and the other end to the hand control valve with the attached spray wand. Turn the cold water faucet on prior to initiating the cleaning process.

To clean the roller, if using water base paint merely insert the paint laden roller into the top of the pre-adjusted enclosure cone and grasp their mated handles with the hand of choice with the thumb pressing downward on the paint roller handle at the point where the shaft bends. Grasp the control valve handle in the other hand and insert the spray wand into the enclosure at the notch in the upper rim of the cone. Depress the control valve handle to turn on the spray, full force. Alternately apply soak and spin cycles until all paint residue is removed from the roller pile. At last apply the final spin cycle to render the roller damp dry and ready for storage or reuse.

SOAK CYCLE: Looking down into the enclosure observe that your wrist movements control the direction and velocity of the rotation of the roller. Soak the entire roller surface by allowing a slow rotation while you move the spray up and down along the length of the roller.

SPIN CYCLE: Direct the spray jet toward the outer edge of the paint roller to induce high speed spin. A short duration high speed spin will throw off enough water and paint residue to ready the roller for another soaking if needed.

FINAL SPIN CYCLE: Induce a spin cycle as described above and move the spray jet slowly from one end of the roller completely to the other end of the roller all the while maintaining the highest rate of spin possible. While the high rate of spin is still in progress shut off the spray abruptly, allowing the spin to continue. This is especially important with the long fiber pile rollers to leave them nearly dry and uniformly fluffed and extended.

OIL BASE PAINT: Cleaning a paint roller after applying oil base paint requires only one simple variation in the above procedure. Interrupt each soak cycle, remove the soaked roller and apply a thin line of liquid dish washing detergent along the length of the roller. Roll the paint roller against the side of the deep sink or other hard surface as though applying paint to distribute the detergent. Return to soak cycle, then spin cycle. Repeat as needed.

Summary, Ramifications and Scope

Accordingly, the reader will see that as claimed the instant invention meets the need by providing a hand held cylindrical enclosure within which a paint roller can be efficiently and thoroughly washed and spun dry without removing the roller cover from its handle, and by providing a washing wand to be held in the operator's other hand for insertion into the enclosure alongside the paint roller. The washing wand provides a jet of water or other solvent of sufficient volume and velocity that, when directed perpendicularly to the roller center axis, penetration and soaking of the fiber occur at that point. Moving the wand tip down into the enclosure directs the jet along the length of the roller and directing the jet slightly off the center axis of the roller induces roller rotation, thus all points of roller surface can be exposed to the penetrating action of the spray jet.

Directing the spray obliquely towards the roller's edge uses the force of the spray to accelerate the roller's rotation to the point that centrifugal forces throw off the paint and solvent leaving the fibers nearly dry and fully extended. The off thrown materials are trapped by the enclosure wall and exhausted through the open bottom into a sink or collecting vessel.

Inasmuch as roller contact with the inside surface of the enclosure would impede the spin action, it is needful that the roller be held in a fixed position within the enclosure. This is accomplished by providing a tapered indexing notch in the in rolled upper rim of the enclosure and indexing groove along the length of the palm side of the enclosure handle. A horizontal segment of the roller handle shaft seats into the indexing notch while the next segment of the roller handle, after a bend of ninety to one hundred and twenty degrees mates with the enclosure handle groove. Thus when grasped with either hand the enclosure and the paint roller are finely fixed relative to each other. The tapers of the rim notch and of the handle groove are provided to accommodate roller shafts of differing diameters, and the adjustment feature of the enclosure handle is provided to accommodate a variety a paint roller handle designs.

I claim:

1. An apparatus for cleaning and spin drying various types of paint rollers in common use without removing a paint applicator element from a handle comprising:

a wand for delivering a jet of solvent at 90 degrees to a wand axis for deep cleaning and for inducing roller spin, wherein said wand consists of an elongated tubular element with connecting means to a standard hand control valve for an operator to hold, control, and deliver solvent under pressure into a tubular device, wherein a terminal end of said tubular device is sealed off and perforated a short distance from said terminal end with a spray orifice penetrating perpendicularly to form a fluid communication between a hollow center of said tubular device and an outer surface, wherein said wand delivers a high velocity jet of solvent for cleaning said paint roller and for inducing a high speed spin for a spin drying process;

an enclosure means for containing a cleaning process to protect said operator and a cleaning area from solvent and paint residue splatters, wherein said enclosure means consists of an open ended cone section suitable in diameter to contain said wand alongside an installed paint roller without physical contact of the paint roller with either said wand or an inner surface of said enclosure means, wherein said cone section is suitable in length to serve as entrapment means of solvent and paint splatters, wherein said cone section has a slope which is suitable for efficient nesting of a plurality of enclosure elements;

a handle means for holding both said enclosure means and said paint roller in a necessary and fixed position relative to each other during the cleaning process and the spin drying process while affixed firmly by means of an operator's hand of choice, wherein said handle means is provided with means for attachment to said enclosure means in a wide range of slide and angular positions to accommodate different positioning requirements of paint rollers of differing handle shaft shapes and dimensions, wherein a palm side of said handle means features means for defining a position of a segment of a paint roller handle shaft such that an operator's hand grasp provides means for holding both the paint roller and said enclosure means firmly in an adjustably fixable relative position by grasping conjoined handles in the operator's hand of choice.

2. The apparatus of claim 1, wherein said spray wand features an enlargement in a diameter near sealed off terminal end means for preventing withdrawal of said spray wand during operation by contact with an upper rim of said enclosure means.

3. The apparatus of claim 2, wherein said spray orifice is located within an enlarged terminal end of said spray wand for providing said spray orifice with enough material mass surrounding said orifice to resist erosion and consequent degradation of jet of solvent.

4. The apparatus of claim 1, wherein said enclosure means features an in-rolled upper rim for reducing a diameter of a top opening of a cone segment to limit egress of random splatters.

5. The apparatus of claim 4, wherein said in-rolled upper rim features cut out segments for indicating a spray wand insertion point and for guiding said spray wand.

6. The apparatus of claim 4, wherein said in-rolled upper rim features notch means for affixing vertical and lateral positions of the paint roller installed for cleaning, wherein said notch means is shaped for accommodating a variety of roller handle shaft diameters.

7. The apparatus of claim 1, wherein said enclosure means has an overall conical shape permitting nesting of pre-assembled enclosure means to achieve greatly increased packaging efficiency, wherein said overall conical shape facilitates separation of enclosure means from die in a fabrication process.

8. The apparatus of claim 1, wherein said enclosure means feature an open top for insertion of said paint roller and said spray wand, and provides visual access into the cleaning process.

9. The apparatus of claim 1, wherein said enclosure means feature an open bottom for allowing nesting of unassembled enclosure means, wherein said enclosure means also feature means for rapid exhaust of solvent and paint residue to prevent build up of swirling liquid which would impede high speed roller spin required for effective spin drying.

10. The apparatus of claim 1, wherein said handle means feature means for defining a placement position for a segment of a paint roller handle shaft, wherein said handle means and said means for defining the placement position affixes the placement position horizontally and angularly within the enclosure means when grasped by said handle means conjoined with said segment of the paint roller handle shaft.

11. The apparatus of claim 1, wherein said handle means feature slideable adjustment means and angular adjustment means, wherein said slideable adjustment means and said angular adjustment means accommodates the paint roller cleaning apparatus to paint rollers with differing handle shapes and diameters.

* * * * *